US009663191B2

(12) United States Patent
Cromartie

(10) Patent No.: US 9,663,191 B2
(45) Date of Patent: May 30, 2017

(54) TELESCOPIC ANCHOR POLE WITH INTERCHANGABLE ATTACHMENTS

(71) Applicant: Brad Cromartie, Pawleys Island, SC (US)

(72) Inventor: Brad Cromartie, Pawleys Island, SC (US)

( * ) Notice: Subject to any disclaimer, the term of this patent is extended or adjusted under 35 U.S.C. 154(b) by 72 days.

(21) Appl. No.: 14/627,683

(22) Filed: Feb. 20, 2015

(65) Prior Publication Data

US 2016/0244129 A1 Aug. 25, 2016

(51) Int. Cl.
*B63B 21/24* (2006.01)
*B63B 21/26* (2006.01)

(52) U.S. Cl.
CPC ..... *B63B 21/243* (2013.01); *B63B 21/26* (2013.01)

(58) Field of Classification Search
CPC ..... B63B 21/24; B63B 21/26; B63B 21/30; B63B 21/243; A01M 31/06; F16M 13/04; F16M 13/06; F16M 13/08
USPC ... 114/230.1, 230.13–230.19, 294, 343, 364, 114/221 R; 43/2, 3; 52/155–165
See application file for complete search history.

(56) References Cited

U.S. PATENT DOCUMENTS 832,565 A * 10/1906 Wilson ..... E02D 5/801 52/157
3,317,168 A * 5/1967 Ziph ..... E04H 12/2223 116/63 P
3,952,878 A * 4/1976 Gorham ..... F41A 23/18 211/64
4,793,646 A * 12/1988 Michaud, Jr. ..... B63B 21/54 114/221 R
4,960,064 A 10/1990 Mestas et al.
5,443,435 A * 8/1995 Wilkinson ..... A45B 3/00 482/109
5,566,460 A * 10/1996 Bates ..... G01C 15/06 33/293
5,749,386 A * 5/1998 Samuel, Jr. ..... E04H 12/2215 135/118
6,220,197 B1 * 4/2001 Pohlman ..... B63B 21/26 114/294
6,408,559 B2 * 6/2002 Mathews ..... 43/3
6,883,264 B1 * 4/2005 Gimbel ..... A01K 81/04 43/6
6,908,250 B2 * 6/2005 Moffatt ..... B21F 1/002 220/315
7,225,579 B2 * 6/2007 Haley ..... A01M 31/06 43/3
7,270,073 B1 9/2007 Waldrop
7,484,699 B1 * 2/2009 Ziegler ..... A45F 3/44 248/156
7,647,878 B1 1/2010 Santiago
7,942,106 B2 * 5/2011 Cromartie ..... B63H 19/08 114/221 R (Continued)

*Primary Examiner* — Ajay Vasudeva
(74) *Attorney, Agent, or Firm* — Southeast IP Group, LLC.; Thomas L. Moses; Cameron C. Applegate

(57) ABSTRACT

A telescopic anchor pole is provided and described for anchoring boats in shallow water as well as functioning as an attachment apparatus for a variety of fishing, hunting, and recreational accessories/equipment. The anchor pole can extend and retract for quick and easy use, as well as allow for efficient storage within a boat. The anchor pole may also include an attachment mechanism allowing a user to attach interchangeable elements such as a decoy, T-handle, camera, or any other desired accessory.

8 Claims, 6 Drawing Sheets

(56) References Cited

U.S. PATENT DOCUMENTS

| | | | | |
|---|---|---|---|---|
| 8,627,592 | B2 | 1/2014 | Sloop | |
| 8,677,919 | B2 | 3/2014 | Bernloehr et al. | |
| 9,156,527 | B2 * | 10/2015 | Camardelle | B63B 21/243 |
| 9,307,744 | B2 * | 4/2016 | Michels | A01K 15/003 |
| 2010/0154850 | A1 * | 6/2010 | Schulz | A45B 9/02 135/66 |
| 2014/0109817 | A1 | 4/2014 | McQuade | |

* cited by examiner

TELESCOPIC ANCHOR POLE WITH INTERCHANGABLE ATTACHMENTS

BACKGROUND OF INVENTION

Commercial and recreational fishing is often conducted in shallow water. Both fresh water and salt water shallows are often populated with a variety of fish. Fishermen who fish these waters precisely locate and anchor their boat in areas where the amount of fish caught will be maximized. Oftentimes fishermen will locate their boat where fish are visually detectable within the water through a technique called sight fishing. When using this technique, the fishermen must make every attempt to minimize noise so as not to scare the fish.

Conventional anchors are typically used to anchor a boat when shallow water fishing. A conventional anchor may take on various forms but generally has the form of a mass located at the end of a rope or chain that is in turn attached to the boat. To anchor the boat, a fisherman simply drops or throws the mass into the body of water letting it sink to a bottom thereof.

Unfortunately, several problems arise when using a conventional anchor during shallow water fishing. First, because the anchor is ordinarily tethered to the boat using a rope or chain, the boat will drift when anchored due to currents within the water. This drifting effect can place the boat in an unintended position other than a position most advantageous for shallow water fishing. Second, a loud noise and splash is produced when the anchor is thrown into the water that in turn can scare away the fish in proximity to the boat. Third, the mass often times drags across the bottom surface of the body of water and stirs up particulate matter such that the fisherman's view of fish within the water is obscured. Additionally, the mass can damage the vegetation growing at the bottom of the body of water as it drags across it.

In view of the above problems and limitations of the art, it is desirable to have an anchor that anchors a watercraft within the water such that the watercraft does not drift due to current. It is further desirable that such an anchor function without producing an excessive amount of noise or obscuring the clarity of the water.

Another outdoor sporting activity frequently performed on or near the water is waterfowl hunting, the practice of hunting ducks, geese, or other waterfowl for food and sport. Waterfowl are frequently hunted on or near bodies of water such as rivers, lakes, ponds, swamps, sloughs, or oceanic coastlines. Boats are used to set up decoys, pick up birds, and travel distances to hunting areas. They can also be covered and used as a blind. Hunters position themselves in camouflage blinds to conceal themselves from waterfowl, while decoys are used to lure the birds within range.

Given the popularity and nature of waterfowl hunting, and the large amount of equipment needed to hunt, it would be desirable to consolidate this equipment by providing a shallow water anchor pole that could also function as a decoy. It is further desirable that this decoy be a removable attachment that could be added to or removed from the anchor pole as needed, and that the anchor pole is designed to allow for the attachment of interchangeable elements as desired by the user.

Embodiments of the present invention provide such an anchor pole. These and other advantages of the invention, as well as additional inventive features, will be apparent from the description of the invention provided herein.

BRIEF SUMMARY OF THE INVENTION

It is an object of the present invention to provide a telescopic anchor pole that can extend and retract for quick and easy use, as well as allow for efficient storage within a boat. It is another object of the present invention to provide a telescopic anchor pole with an attachment mechanism allowing a user to attach interchangeable elements such as a decoy, T-handle, camera, or any other desired accessory.

DESCRIPTION OF THE DRAWINGS

These and other features, aspects, and advantages of the present invention will become better understood with regard to the following description, appended claims, and accompanying drawings where:

DETAILED DESCRIPTION OF THE INVENTION

Embodiments of the present invention address deficiencies of the art with respect to marine anchors and provide a novel apparatus for facilitating frequent manual deployment and retraction of a quiet shallow water anchor. Additionally, the present invention addresses the desire to have a single apparatus that functions to anchor a boat and allows for the attachment of multiple accessories useful in fishing, hunting, boating, and the like. In one embodiment of the invention, an apparatus for anchoring a boat to a bottom of a body of water is disclosed. It will be recognized that while the following description will utilize such an exemplary environment in describing the various features and functionality of the present invention, such description should be taken by way of example and not by way of limitation.

Figure 1:
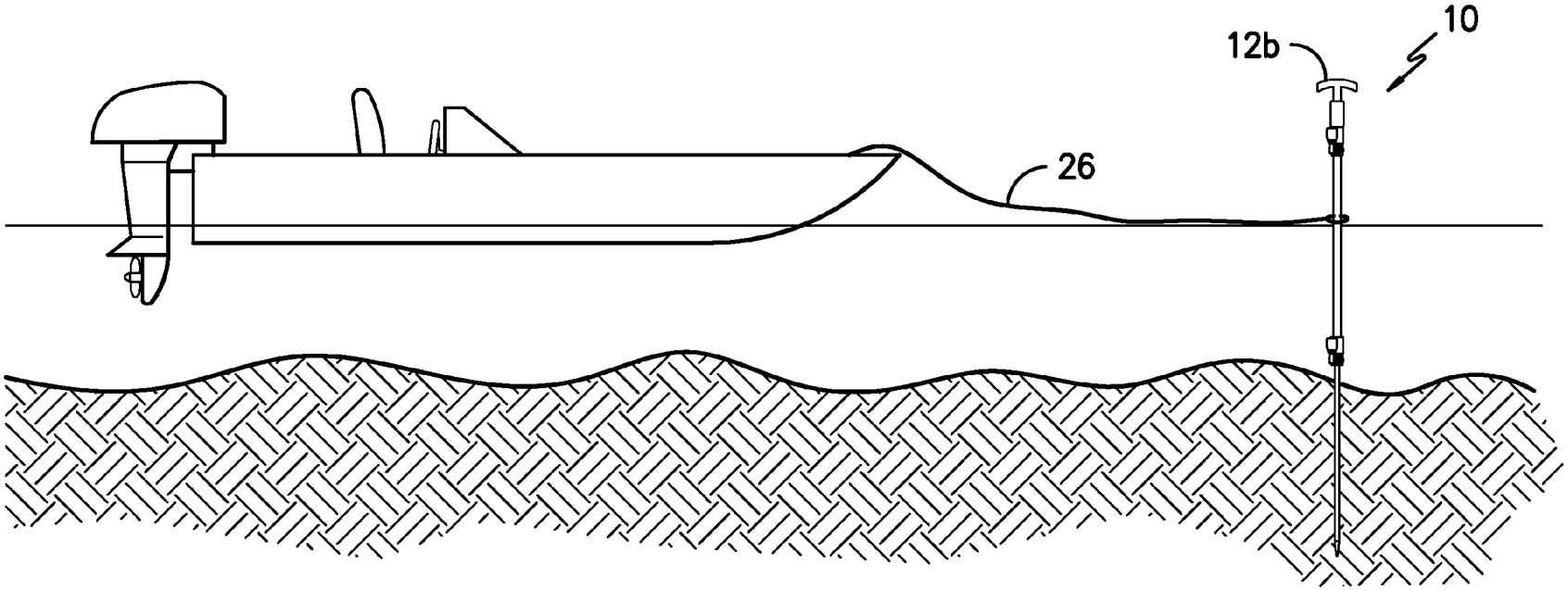
FIG. 1 illustrates a side view of one embodiment of a telescopic anchor pole in-use with a T-handle attachment.

FIG. 1 illustrates one embodiment of the present invention as it may be used during operation. Although illustrated as tied to the bow of the boat, the anchor pole 10 may be mounted, secured, or tethered to other locations of the boat, and is not limited to the bow only. A passenger of the boat can control the telescopic anchor pole 10 while seated anywhere within the boat. The pole 10 may be secured to any part of the boat through the use of a bracket, clamp, tie down, or any other suitable securing means 26 and method. For a more rigid positioning, one may use a securing mechanism 26 like a clamp or bracket to secure the pole 10 directly to the boat, thus minimizing mobility and drift during anchoring. For a more flexible anchoring, one may use securing means 26 such as a rope, whereby the boat may be allowed to drift slightly while still remaining in a generally fixed location in the water. FIG. 1 shows an anchor pole 10 secured to the bow of the boat, whereby one end of a rope is tied to the boat and the other end of the rope includes a ring that may be slipped around the pole 10, thus securing the pole 10 to the rope and the rope to the boat. It should be noted that the anchor pole 10 can also be attached to the stern of a boat. The anchor pole 10 may include a tapered, pointed or spear-like projection 20 on the bottom end whereby the pole 10 may be driven into the ground beneath the water, thus anchoring the boat in place.

Figure 2:
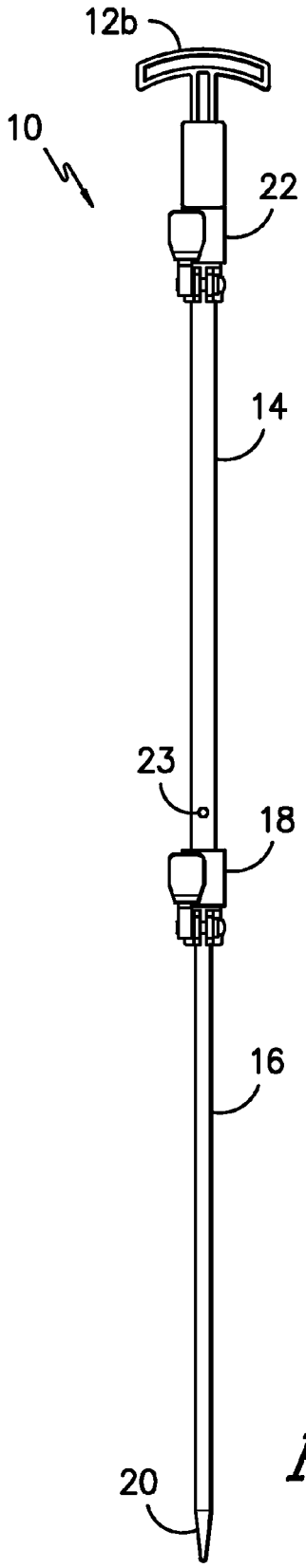
FIG. 2 illustrates a perspective view of one embodiment of a telescopic anchor pole, in an extended position, with T-handle attachment.
Figure 3:
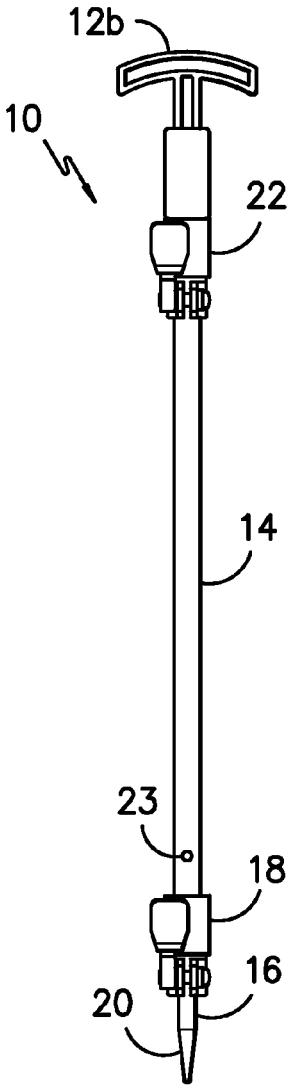
FIG. 3 illustrates a perspective view of a telescopic anchor pole, in a retracted position, with T-handle attachment.
Figure 4:
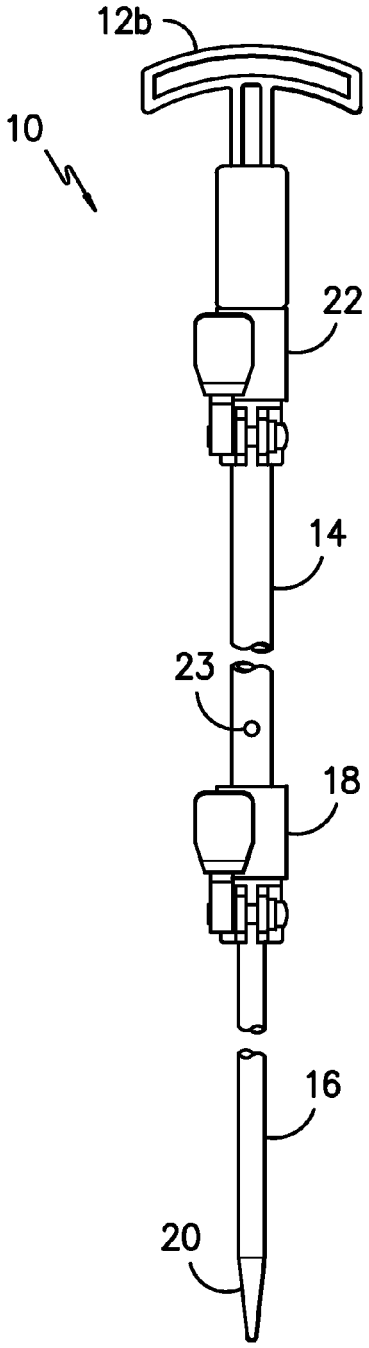
FIG. 4 illustrates a side view of a telescopic anchor pole with T-handle attachment inserted.
Figure 5:
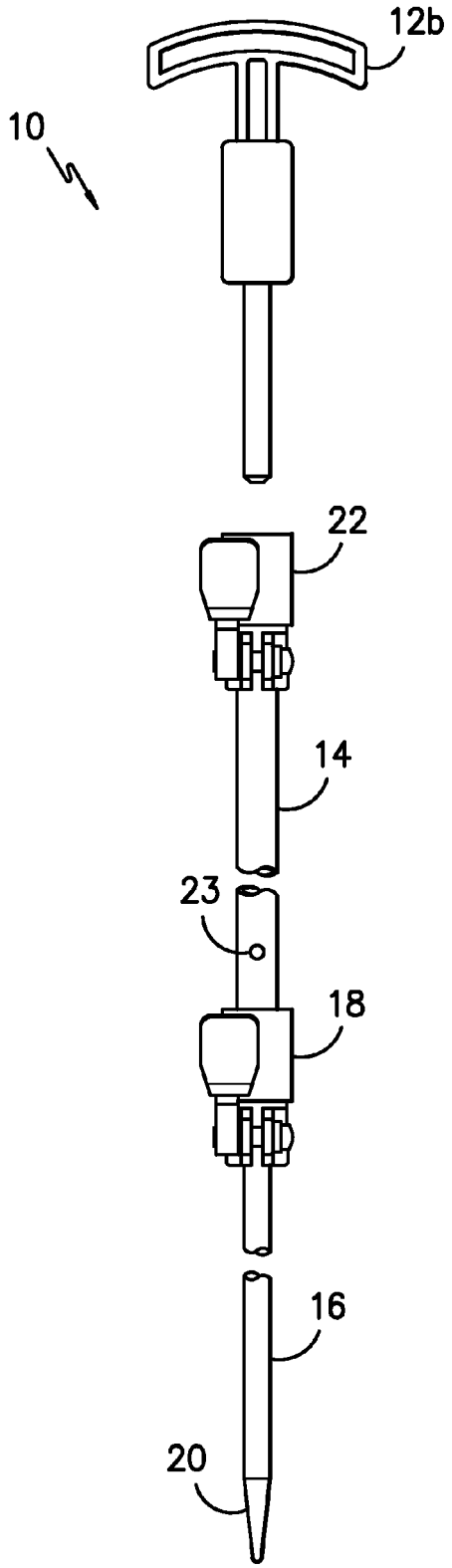
FIG. 5 illustrates an exploded side view of a telescopic anchor pole with T-handle attachment.

An anchor pole of the present invention is designed to be adjustable in length; this adjustability preferably being accomplished through the use of a telescopic design. FIGS. 2 and 3 illustrate a perspective view of a telescopic anchor pole 10 with T-handle attachment 12*a*. The anchor apparatus 10 is comprised of at least two tubular sections, although more than two sections may be used. In a preferred embodiment, the anchor pole 10 is comprised of two tubular sections, referred to herein as a first pole 14 and a second pole 16. The tubular sections may be hollow or a combination of hollow tubes and solid rods. For example, the anchor apparatus 10 may comprise one or more hollow tubes with a solid rod fitting concentrically inside the hollow tube(s); or, the apparatus 10 may comprise all hollow tubes fitting concentrically inside one another. FIGS. 4-7 illustrate a side view of a preferred embodiment whereby the hollow diameter of the first pole 14 is larger than the diameter of the second pole 16 to a degree such that the second pole may 16 be inserted into the first pole 14 while still maintaining frictional engagement sufficient enough to hold the poles in position together. The first pole 14 preferably includes a locking mechanism 18, 22 on each end, such as a cam lock, whereby the upper end of the second pole 16 may be inserted into the lower end of the first pole 14 and locked into position, as shown by FIGS. 2 and 3. The second pole 16 may also include a pointed projection 20 on its lower end to facilitate insertion of the anchor pole 10 into the ground.

It is to be understood that the embodiment described above is a preferred arrangement and is not limiting the anchor pole 10 to a specific design. In an alternative embodiment, the second pole 16 may be larger in diameter whereby the lower end of the first pole 14 is inserted into the upper end of second pole 16 and locked into place via a locking mechanism 18 that may be present on the upper end of the second pole 16. The locking mechanism 18 may be a cam lock, as shown, a clamp mechanism, a spring loaded button present on one pole that locks into a corresponding slot present on the other pole, or any other suitable locking mechanism.

FIG. 2 illustrates the second pole 16 inserted into the first pole 14 and locked in a position whereby the second pole 16 is fully extended. The telescopic design may be infinitely adjustable and allows the second pole 16 to be retracted or extended to any length desired by the user. For example, a fully extended position would be preferable when fully operating the anchor pole 10 while fishing or boating; however, if the water is very shallow, the user may slide the second pole 16 into any other desired position, such as half-extended or ¾ extended for example, and lock the pole 10 into place. Alternatively, the anchor pole 10 may be collapsed or fully retracted, as shown in FIG. 3. This fully retracted position may be preferable for transporting or storing the pole 10 within the boat when not in use. In a preferred embodiment, the telescopic sections are infinitely adjustable yet include a stay mechanism 23 to prevent the individual poles sections from coming fully apart when the pole 10 is in a fully extended position. This stay mechanism 23 may include a spring loaded button, internal clamping, frictional locking mechanism, or the like, that engages and holds or locks the poles together. Alternatively, the sections may be designed such that the come fully apart for storage, cleaning, and transportation.

The telescopic anchor pole 10 may also be designed to function as an attachment apparatus for optional attachments 12 such as hunting decoys 12*b*, a T-handle 12*a*, bicycle handle-type grips, cameras, and the like. Additionally, the pole 10 may receive a paddle attachment for rowing, a gig attachment for fishing, or a Y shaped attachment or duck foot to be used like a push pole. The upper end of the first pole 14 may be adapted to receive an interchangeable attachment element 12, which may be inserted into the first pole 14 and locked into place using a cam lock or similar locking mechanism 22. Alternatively, the actual attachment 12 itself may include a built-in locking mechanism 22 to lock the attachment 12 to the anchor pole 10. FIGS. 2-5 show a T-handle 12*b* attachment being inserted into the upper end of the first pole 14 and locked into place through the use of a cam lock 22 or similar suitable mechanism. The attachment of a T-handle 12*b* greatly facilitates driving the anchor pole 10 into the ground and allows a user to easily grasp the pole 10 via the T-handle 12*b* for removing the anchor pole 10 when finished.

Figure 6:
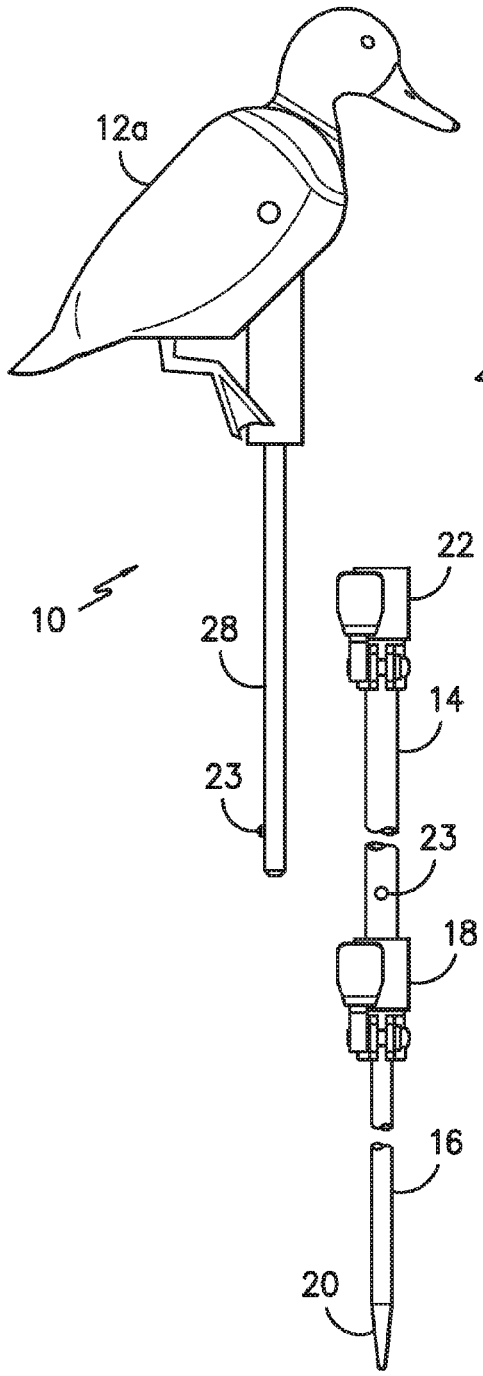
FIG. 6 illustrates an exploded side view of a telescopic anchor pole with decoy attachment.
Figure 7:
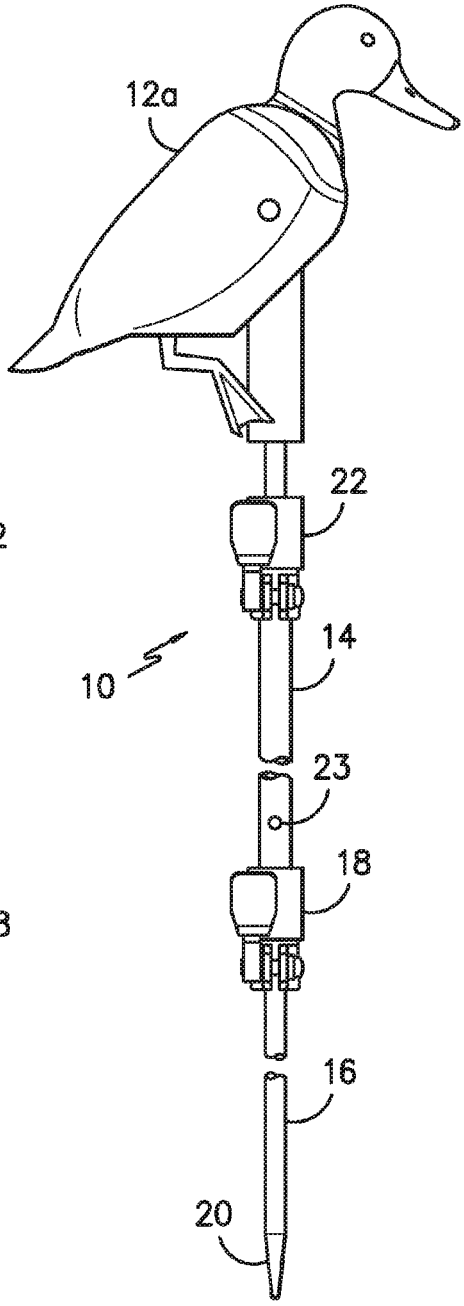
FIG. 7 illustrates a side view of a telescopic anchor pole with decoy attachment.
Figure 8:
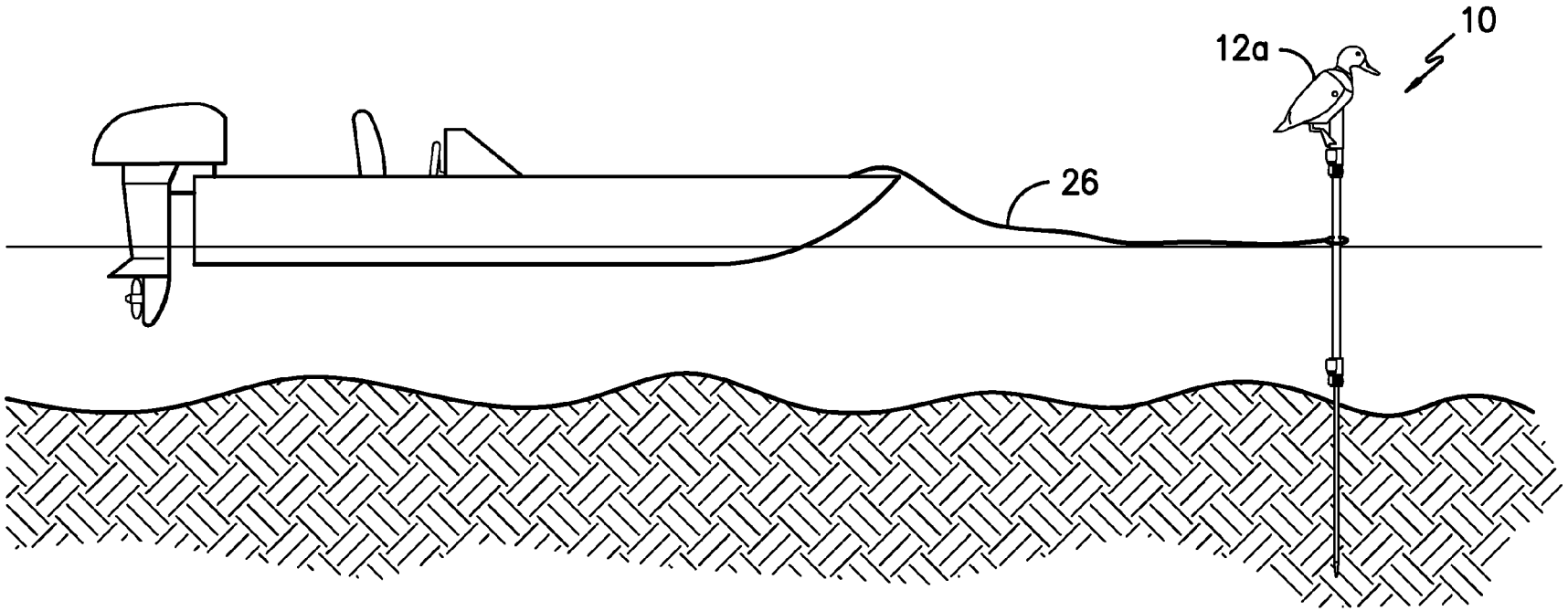
FIG. 8 illustrates a preferred embodiment of a telescopic anchor pole in-use with a decoy attachment.
Figure 9:
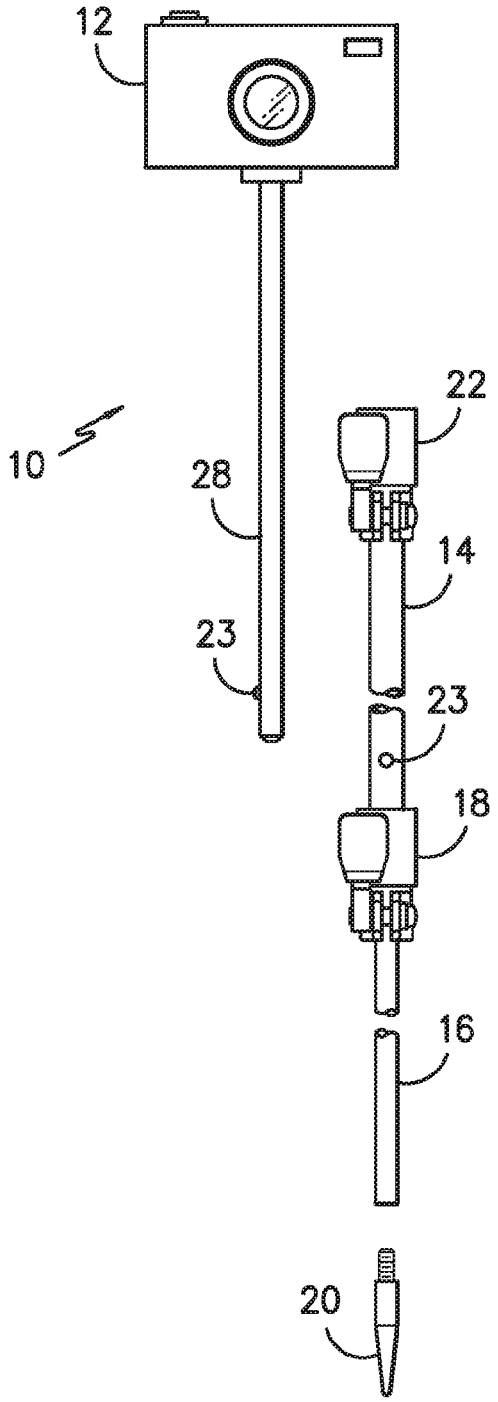
FIG. 9 illustrates an exploded side view of a telescoping anchor pole with camera attachment including an extended shaft and a removable pointed projection.

FIGS. 6-7 similarly show a decoy 12*a* attached to the upper end of the anchor pole 10. FIG. 8 illustrates the telescopic anchor pole 10 secured to a boat and functioning as a decoy apparatus. As in FIG. 6, the attachment apparatus 12 may also he telescopic whereby the decoy 12*a*, T -handle 12*b*, etc. may include an extended. shaft 28 to allow the attachment 12 to be raised or lowered in height relative to the anchor pole 10 as needed.

It is contemplated that a user may transport the anchor pole 10 in a boat with said pole 10 in a fully retracted position. Once the user has boated to a desired location, the anchor pole 10 may be extended to a length sufficient for anchoring the boat. A T-handle apparatus 12*b* may be attached to the top of the anchor pole 10 to facilitate driving the pole 10 into the ground. If the user is hunting wild fowl, the T-handle attachment 12*b* may be removed and replaced with a decoy attachment 12*a* for attracting ducks, geese, etc. It is to be understood that other attachments 12 may be used as well, such as camera for capturing photos and/or videos, a light or reflector for easy identification of the boat, a flag for identification or decorative purposes, or other suitable and useful attachments. The attachment elements 12 are not limited to those described above, but could include any attachment as desired. Once the user is ready to remove the anchor pole 10, the attachment apparatus 12, whether it be a decoy 12*a*, flag, etc., may be removed and replaced with a T-handle 12*b*, the pole 10 can be pulled from its anchoring position, fully retracted, and stored compactly within the boat. It is to be noted that a user is not limited to the use of a single anchor pole 10 and may use multiple poles at one time. For example, a user may boat to a particular hunting area and drive into the ground one or more anchor poles 10 containing a decoy attachment 12*a*, then boat to an area some distance from the decoy(s) and drive another anchor pole 10 into the ground to anchor the boat. In this way, multiple poles with multiple attachments may be used interchangeably at one time.

What is claimed is:

1. A telescopic anchor pole comprising:

at least two concentric tubular sections designed to slide into one another in telescopic relation forming a single telescopic member;

a wild fowl imitation decoy attachment removably and telescopically connected to an upper end of said telescopic member;

a conical wedge pointed projection removably attached to a bottom distal end of said telescopic member;

an infinitely adjustable means for securing said attachment to said upper end of said telescopic member;

an infinitely adjustable means for selectively securing said tubular sections into position; and a means for securing said pole to a boat selected from the group consisting of a bracket, clamp, and rope with attached securing ring.

2. The telescopic anchor pole of claim 1, wherein said decoy attachment is replaceable by a camera attachment.

3. The telescopic anchor pole of claim 2, whereby said decoy attachment and said camera attachment each further includes an extended shaft for extending or retracting said attachment relative to said anchor pole.

4. The telescopic anchor pole of claim 1, whereby said means for selectively securing said tubular sections into position is selected from the group consisting of a cam-lock, a spring-loaded button, and a clamp.

5. The telescopic anchor pole of claim 1, further including a stay means for preventing said concentric tubular sections from coming apart.

6. The telescopic anchor pole of claim 5 whereby said stay means is a spring loaded button.

7. A telescopic anchor pole comprising:

at least two concentric tubular sections designed to slide into one another forming a single telescopic member;

a wild fowl imitation decoy attachment removably and telescopically connected to an upper proximal end of said telescopic member;

an infinitely adjustable means for securing said decoy attachment to proximal end of said telescopic member;

an infinitely adjustable means for selectively securing said tubular sections into position; and a means for securing said anchor pole to a boat.

8. The telescopic anchor pole of claim 7 whereby said decoy attachment is telescopically adjustable relative to said anchor pole.

* * * * *